US011006213B1

(12) United States Patent
Hefner

(10) Patent No.: US 11,006,213 B1
(45) Date of Patent: May 11, 2021

(54) SHOWER ENTERTAINMENT SYSTEM

(71) Applicant: Timothy Hefner, Claremont, NC (US)

(72) Inventor: Timothy Hefner, Claremont, NC (US)

( * ) Notice: Subject to any disclaimer, the term of this patent is extended or adjusted under 35 U.S.C. 154(b) by 0 days.

(21) Appl. No.: 16/674,867

(22) Filed: Nov. 5, 2019

(51) Int. Cl.

| | |
|---|---|
| ***H04R 1/02*** | (2006.01) |
| ***H04R 9/06*** | (2006.01) |
| ***H04R 1/44*** | (2006.01) |
| ***H04R 3/00*** | (2006.01) |

(52) U.S. Cl.
CPC ..... *H04R 1/44* (2013.01); *H04R 1/025* (2013.01); *H04R 3/00* (2013.01); *H04R 2420/07* (2013.01); *H04R 2420/09* (2013.01)

(58) Field of Classification Search
CPC ..... H04R 1/44; H04R 1/025; H04R 3/00
See application file for complete search history.

(56) References Cited

U.S. PATENT DOCUMENTS 5,329,650 A * 7/1994 Zaccai ..... E03C 1/0408 4/596
5,664,015 A * 9/1997 Ford ..... H04M 1/18 379/433.01
6,240,181 B1 * 5/2001 Tunstall ..... H04M 1/6033 379/428.01
7,400,917 B2 * 7/2008 Wood ..... H04B 1/3888 455/575.1
D862,418 S * 10/2019 Distefano ..... D14/216
2005/0181745 A1 * 8/2005 Wood ..... H04M 1/605 455/90.3
2008/0132289 A1 * 6/2008 Wood ..... H04M 1/605 455/566
2008/0188270 A1 * 8/2008 Bjorklund ..... H04M 1/6058 455/569.1
2009/0312058 A9 * 12/2009 Wood ..... H04M 1/605 455/566
2010/0311475 A1 * 12/2010 Takatsuka ..... H04M 1/18 455/575.1
2014/0050347 A1 * 2/2014 Tsai ..... H04R 1/02 381/334
2014/0193017 A1 * 7/2014 Fortin ..... H04R 1/021 381/334

* cited by examiner

*Primary Examiner* — Simon King
(74) *Attorney, Agent, or Firm* — Gugliotta & Gugliotta LPA

(57) ABSTRACT

A shower entertainment system provides a waterproof exo-housing forming a cavity for receiving a smart phone. A waterproof speaker is supported within cavity and is in operational interconnection with the smart phone. A touch-screen access screen facilitates manual control of speaker through the smart phone. A hook extends from the housing for retention from a shower head. The hook further articulates between a flat nested position and an extended upward position. The hook alternately is positioned angular to the rear surface of the housing for the housing while placed flat on a horizontal surface. The instant abstract is neither intended to define the invention disclosed in this specification nor intended to limit the scope of the invention in any way.

6 Claims, 4 Drawing Sheets

SHOWER ENTERTAINMENT SYSTEM

RELATED APPLICATIONS

There are no previously filed, nor currently any co-pending applications, anywhere in the world.

BACKGROUND OF THE INVENTION

1. Field of the Invention

The present invention relates generally to cases and protection devices for cellular phones or similar portable electronic devices and, more particularly, to a waterproof cell phone case adapted for facilitating entertainment content thereon.

2. Description of the Related Art

For whatever unknown reason, whether via genetic inheritance or cultural acquisition, people tend to enjoy signing or listening to music. Such an activity relaxes, invigorates, and positively effects one's mood. Such effects are especially beneficial subsequent to early morning, and are often coordinated with one's time in the bathroom such as singing in the shower.

While music in the shower is popular, such activities risk water damage to the music playing device which, currently, damages a cellular phone or smart-speaker device.

Some methods and devices are known that incorporate various mechanisms for providing water resistant protection for electronic devices. For example:

U.S. Pat. No. 8,399,764, issued in the name of Klosky, teaches a water resistant case for a mobile device. Such a case includes a buoyancy feature, and is sized and configured so that the case is buoyant in water when containing the mobile electronic device. A closure portion of the case is movable between an extended position for receiving the mobile electronic device, to a folded position when the case contains the mobile electronic device. In the folded position the closure portion is provided adjacently to the rest of the case. The configuration of the case is such that the case can be relatively form fitting to the mobile electronic device.

U.S. Pat. No. 9,155,368, issue in the name of Chang, teaches a waterproof protection pouch for mobile devices which comprise a coupling set, a pouch, a sealing member and a retrieval tray. The coupling set includes a rigid ring, an opening and a clamping ring. The rigid ring has an annular latch groove on the outer circumference thereof. The pouch includes a connecting portion connected to the coupling set and a pouch opening. The sealing member includes a cap, a latch portion latched on the latch groove and a plug to wedge in the opening. The plug includes at least one annular sealing ridge on the outer circumference thereof. The retrieval tray has a carrying plate to hold the mobile device and a retrieval portion running through the pouch opening and opening of the coupling set to connect to the sealing member. Through the rigid ring and sealing member, the waterproof protection pouch can provide watertight and pressure withstanding effects.

And, U.S. Patent Publication 2010/0048267, published in the name of Lin, describes a disposable protector case for cell phones with touchable lenses to be used with a touch-screen cell phone. The protector case provides the ability to protect the LCD screen of a touchscreen cell phone from being scratched by incorporating into a protector case for the touchscreen LCD a thin transparent lens so that an individual's fingers or a stylus does not directly come in contact with the touchscreen of the LCD phone but instead, are shielded by the lens so that in the event that there are scratches on the lens, the case can be easily discarded and replaced with another inexpensive case which contains the protector case to protect the cell phone and the lens to protect the touch-screen LCD.

Consequently, a need exists for a waterproof system adapted for use in conjunction with an entertainment application function of a portable electronic device, preferably a smart phone or smart speaker device.

SUMMARY OF THE INVENTION

It is thus an object of the present invention to provide a case protection device for a cellular phone It is a feature of the present invention to provide a case or similar protection device for cellular phones or similar portable electronic that is both waterproof and adapted for facilitating entertainment content thereon.

The present invention provides a system for facilitating the use of a portable electronic device, such as specifically some smart phones, for watching videos, streaming content, playing music or podcasts, or other functionality of such devices. Further, such use is facilitated even in water susceptible areas such as while in the bathroom, or even in the shower. A shower entertainment system provides a waterproof speaker and allows access, viewing and control to entertainment content from or through a smart phone from a shower. A waterproof casing keeps your device dry, while still giving the ability to control the video, search for new content, or switch applications on the phone. A built-in waterproof wireless speaker lets you hear your device over the noise of the shower, a blow dryer, etc.

Such a shower entertainment system allows optimal usage of such smart phone devices while keeping the device protected and safe from water intrusion.

Further objects, features, elements and advantages of the invention will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
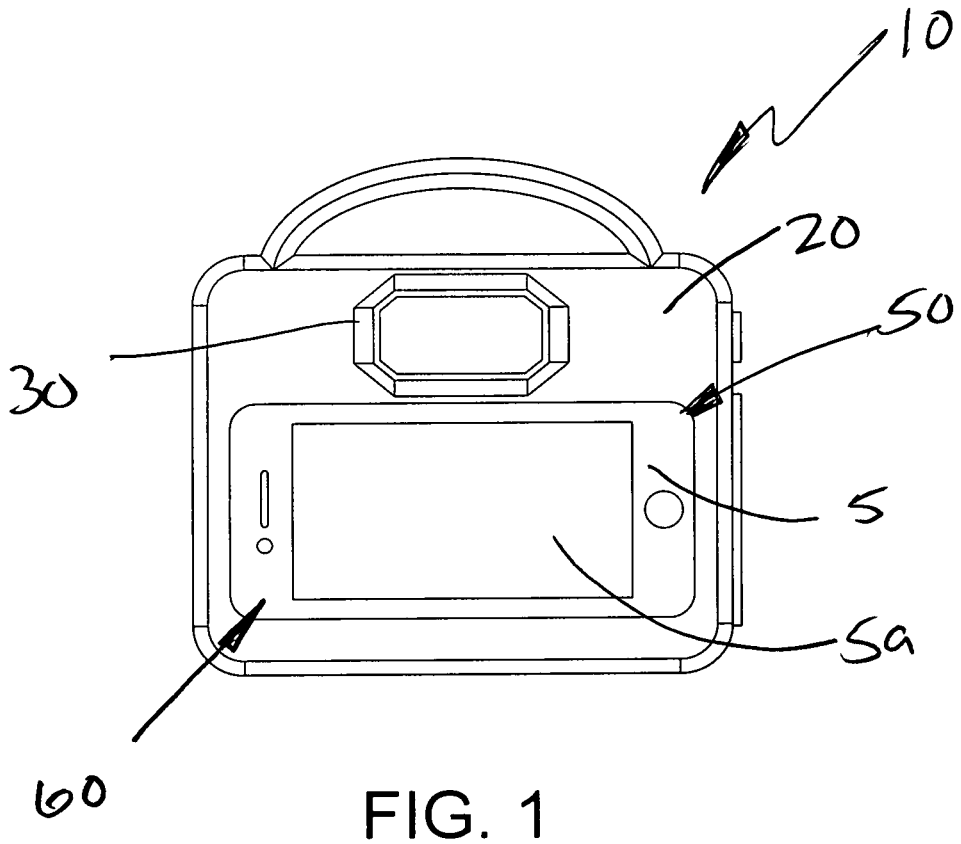
FIG. 1 is a front elevational view of a shower entertainment system according to the preferred embodiment of the present invention.

The best mode for carrying out the invention is presented in terms of its preferred embodiment, herein depicted within the Figures. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

It should also be understood that, unless a term is expressly defined in this patent there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112(f).

The best mode for carrying out the invention is presented in terms of its preferred embodiment, herein depicted within the Figures.

1. Detailed Description of the Figures

Before explaining the present invention in detail, it is important to understand that the invention is not limited in its application to the details of the construction illustrated and the steps described herein. The invention is capable of other embodiments and of being practiced or carried out in a variety of ways. It is to be understood that the phraseology and terminology employed herein is for the purpose of description and not of limitation.

Referring now to the drawings, wherein like reference numerals indicate the same parts throughout the several views, a shower entertainment system, generally noted as 10, is shown according to the preferred embodiment of the present invention. The shower entertainment system 10 consist essentially of a waterproof exo-housing 20 for receiving an otherwise conventional cellular phone 5 including: a waterproof housing 20; a waterproof speaker 30; an attachment system 40; a receiving cavity for housing cellular phone 50; and a touchscreen access screen 60 for facilitating manual control of the cellular phone 5.

Figure 2:
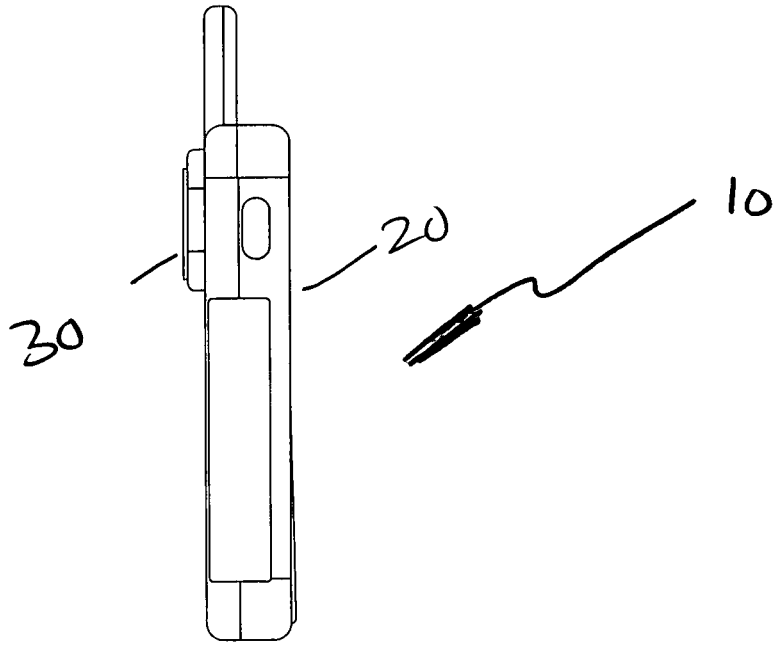
FIG. 2 is right side elevational view thereof.
Figure 3:
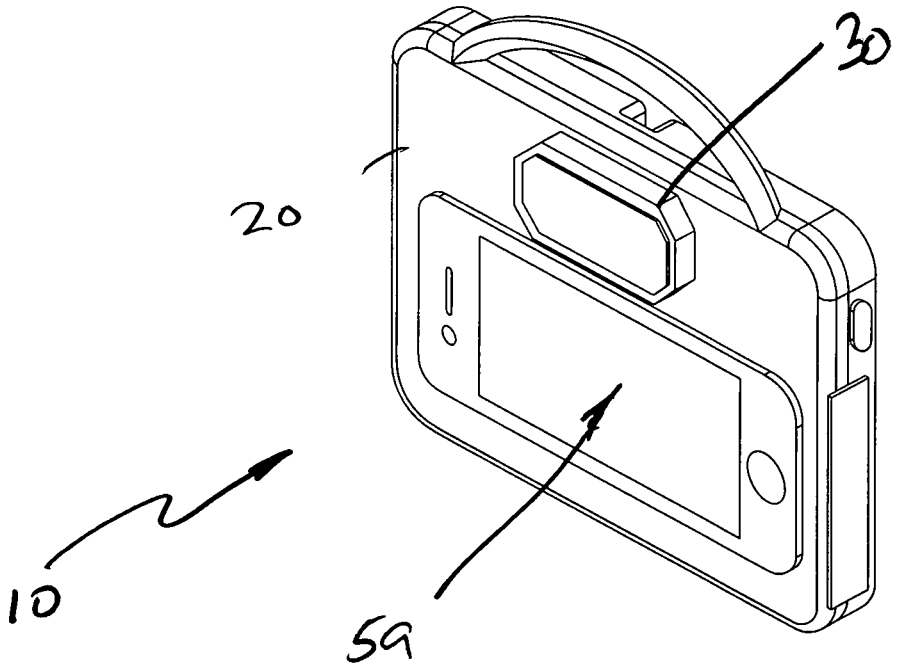
FIG. 3 is a front perspective view thereof.
Figure 4:
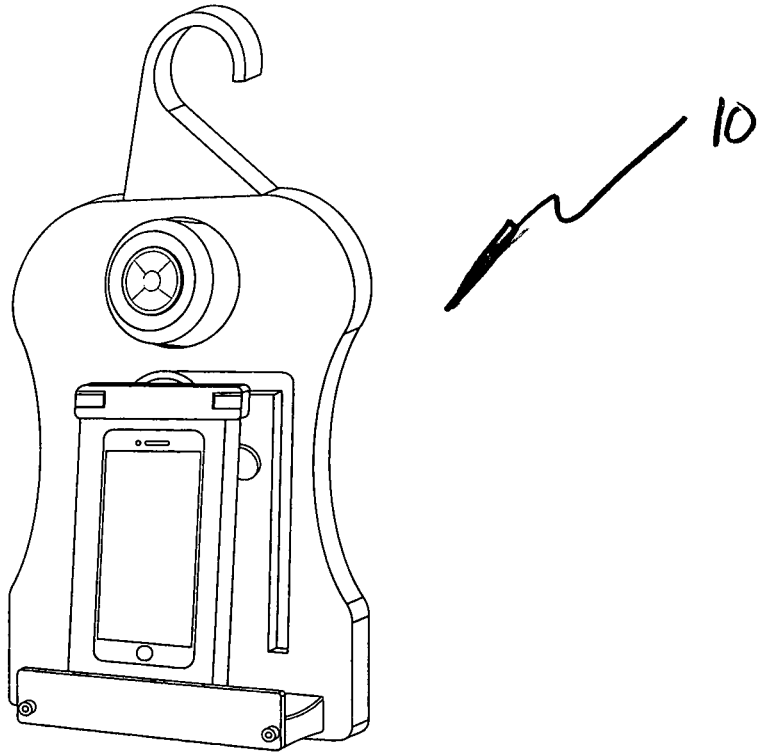
FIG. 4 is a front perspective rendering view thereof.

The waterproof housing 20 provides a case for receiving an otherwise conventional cellular telephone 5. The housing 20 may form a receiving chamber for such receiving of the phone 5. As shown according to the first embodiment, shown best in conjunction with FIG. 2, the receiving cavity 50 may be configured to receive the phone 5 from a rear housing surface in generally coplanar configurations. In such an orientation, the phone 5 is sealed within the chamber 22 with a water tight closure 24 formed by the receiving cavity 50 such that the control surface 5*a* of the phone 5 may thereafter be accessible. The receiving cavity 50 may be configured to receive the phone 5 from a side of the housing 20 in a generally collinear manner. In such an orientation, the phone 5 is still sealed within the chamber 22 with a water tight closure 24 such that the control surface 5*a* of the phone 5 may thereafter be accessible. In any configuration variation it is intended that sealing the phone 5 in a water tight chamber is accomplished while still maintaining control that may support the operation of the claimed functionality. It should be apparent to one having ordinary skill in the relevant art, in light of the present teachings, that other variations may be a matter of design choice or provide additional functionality as long as the core functionality of the present invention is retained.

The waterproof speaker 30 is further provided in operational interconnection with the cellular phone 5 contained within the receiving cavity 50. The speaker 30 provides an external audio output to the phone 5. The speaker 30 may be of a waterproof or water resistant configurations such as to allow for use within a shower or other bathing facility.

Figure 5:
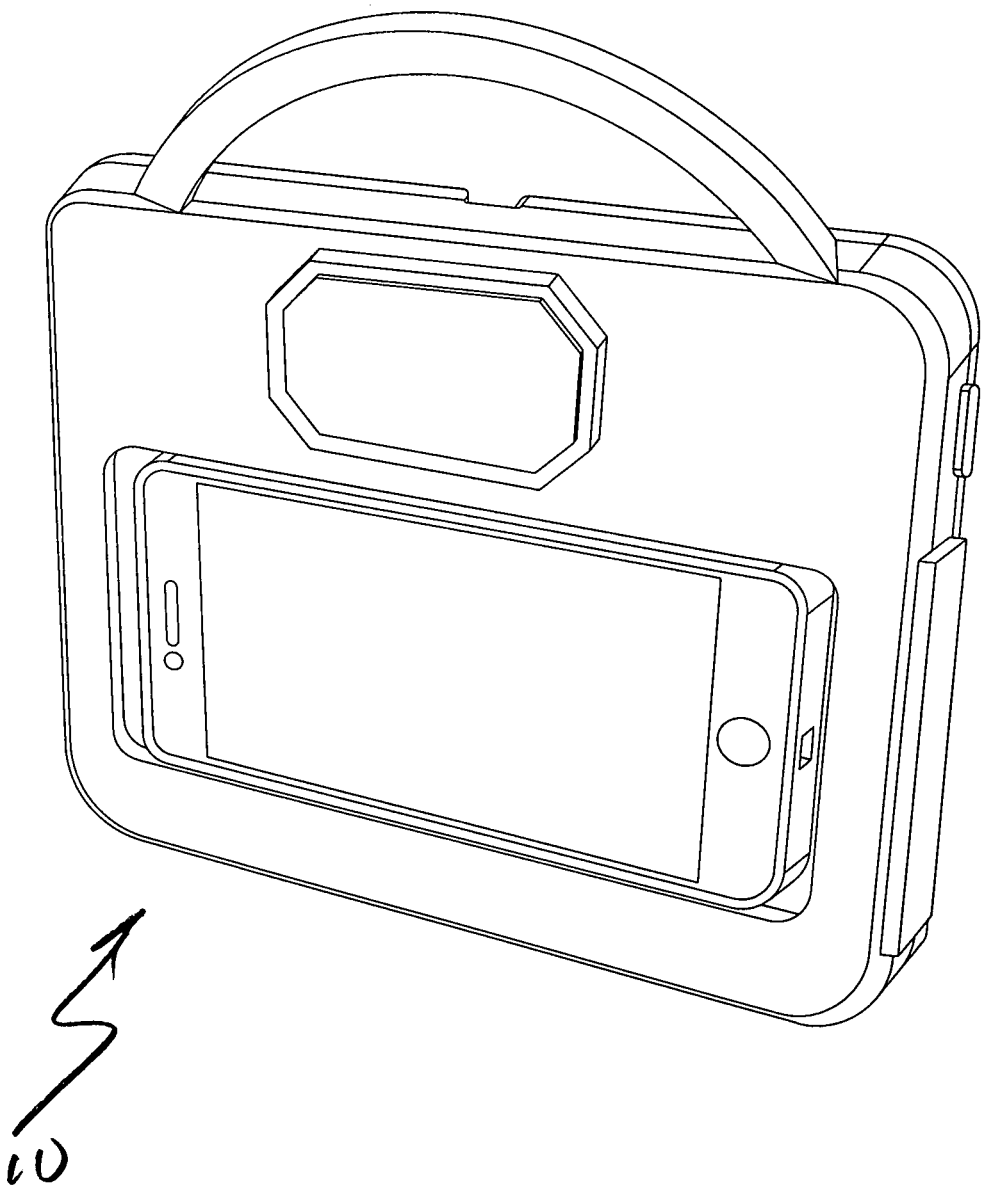
FIG. 5 is a front perspective rendering view thereof shown having a support hook 44 in an extended condition.
Figure 6:
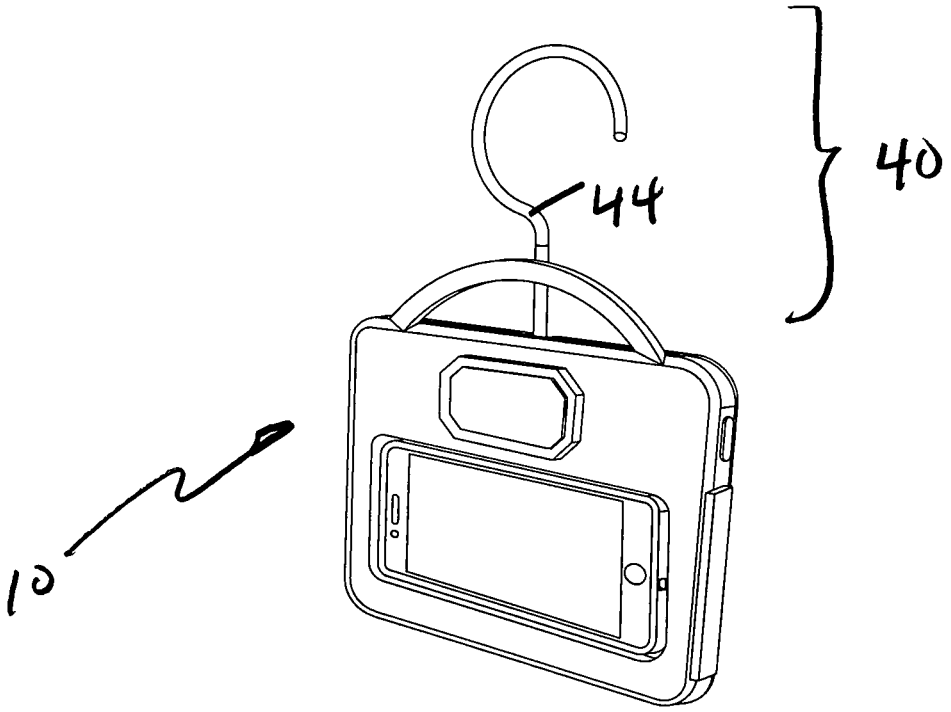
FIG. 6 is a rear perspective rendering view thereof shown with the support hook 44 a retracted condition.
Figure 7:
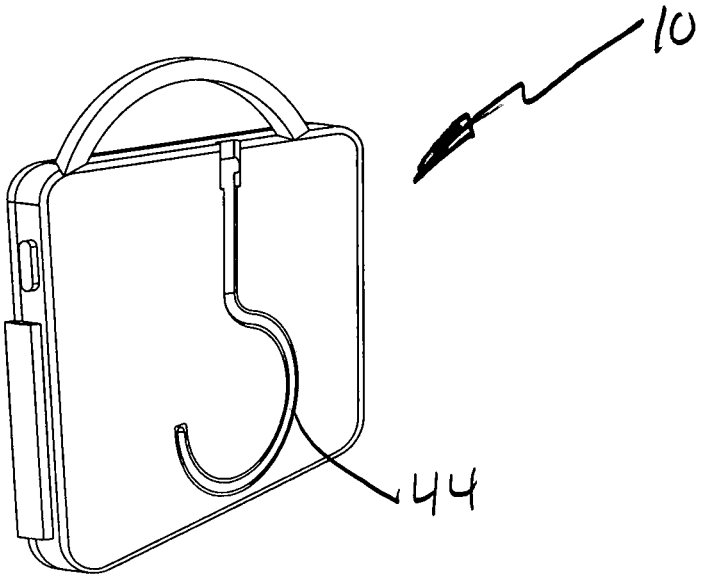
FIG. 7 is a side elevational rendering view thereof shown with the hood support 44 in a partially extended condition and forming a surface support stand.

The attachment system 40 may provide for securing the shower entertainment system 10 during operation. The attachment system 40 may be in the form of a hook structure 44 that extends from the housing 20 such as to allow for retention of the entire device 10 from a shower head or connection plumbing to a shower head (not shown). As seen in conjunction with the first variant of FIG. 1 and FIG. 2, the hook structure 44 may be rigidly formed as an extension of or connection to the housing 20 in a cantilevered fashion. Additionally, as seen in conjunction with the second variant of the preferred embodiment of the present invention, the hook structure 44 may be formed as a pivoting structure that may be nested flat within the rear surface of the housing (see FIG. 6) or extended upward (see FIG. 5) to provide the upwardly extended connection for securing the shower head or the like. Such pivoting, multi-positional hooks may alternately be articulated to a position angularly disposed to the rear surface of the housing 20. Such a angularly positioned structure may provide a surface stand for supporting the housing 20 in a generally upright orientation while placed flat on a horizontal surface. As may be apparent to those having ordinary skill in the relevant art, in light of the present teachings, various other systems for placing, positioning or attaching the shower entertainment system to be positioned within the area of intended use (i.e., a shower). Such other systems may include, but not be limited to, other fixtures such as suction cups or other types of reversible mechanical attachment.

In the intended primary function of the present invention, the receiving cavity for housing cellular phone 50 may be sized and configured for receiving a smart phone type of portable phone 5. This may include having a USB or Lightning communication connector attachment therein for functionally communicating with the phone 5. In a functional equivalent manner, the speaker 30 may be in wireless communication with the smart phone 5 through BluetTooth®, Wi-Fi® or similar or equivalent Internet of Things (IoT) type of wireless communication. I should also be noted that a broad range of functional equivalents may exist including a cavity 50 adapted for receiving in a functional communication with other types of portable electronic devices.

Finally, a touchscreen access screen 60 is provided that interfaces with the cavity 50 for facilitating manual control of the cellular phone 5. The access screen 60 may be of a planar, pliable nature that allows manipulation of the control surface 5*a* of the phone 5 may be directly accessible in a manner that may be universally interchangeable among various types of smartphones. A functional equivalent may further including depressable buttons or surface sections that align with a specific portion of control surface 5*a* such at to transfer forces through the buttons for operational communication to the control surface 5*a*. Other functional equivalents should be broadly construed.

2. Operation of the Preferred Embodiment

In operation, a shower entertainment system 10 of the preferred embodiment of the present invention allows a user to watch videos or listen to audio content on their smart phone while in the shower. As a modern technology facilitated extension of 'singing in the shower', the present invention allows a user to have and use a phone, tablet or similar portable electronic device while in a sealed waterproof case to watch videos in the shower. Provided with an accessible touchscreen access screen 60, control of a device synchronized with a water proof wireless speaker provides sound that is not compromised by the sealed, waterproof nature of the enclosure. The screen 60 further allows the device to fully function with the touchscreen capabilities.

The foregoing descriptions of specific embodiments of the present invention are presented for purposes of illustration and description. The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but is to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by the Drawings and Specification appended hereto and to their equivalents. Therefore, the scope of the invention is in no way to be limited only by any adverse inference under the rulings of *Warner-Jenkinson Company, v. Hilton Davis Chemical,* 520 US 17 (1997) or *Festo Corp. v. Shoketsu Kinzoku Kogyo Kabushiki Co.,* 535 U.S. 722 (2002), or other similar caselaw or subsequent precedent should not be made if any future claims are added or amended subsequent to this Provisional Patent Application.

What is claimed is:

1. A waterproof portable entertainment system comprising:

a protection housing forming a cavity for receiving a portable electronic device, wherein the system of functional communication of audio functions between a speaker and the portable electronic device comprises:

a USB or Lightning communication connector attachment positioned within the cavity and functionally connecting with the portable electronic device; and a communication conduit between the communication connector and the speaker;

said cavity being sealable in a waterproof manner;

the speaker supported in said housing; and an attachment system for securing the shower entertainment system within a shower, the attachment system comprises a hook structure that extends from the protection housing to allow for retention from a shower head or connection plumbing to a shower head and wherein said hook structure further comprises a pivoting structure that articulates between a flat nested position within a rear surface of the housing and an extended upward position.

2. The waterproof portable entertainment system of claim 1, wherein said pivoting structure may further be articulated to a position angularly disposed to the rear surface of the housing and forming a surface stand for supporting the housing in a generally upright orientation while placed flat on a horizontal surface.

3. A waterproof portable entertainment system comprising:

a protection housing forming a cavity for receiving a portable electronic device, wherein said portable electronic device comprises a smart phone;

said cavity being sealable in a waterproof manner;

a speaker supported in said housing; and a system of functional communication of audio functions between the speaker and the portable electronic device, wherein the system of functional communication of audio functions between the speaker and the smart phone comprises:

said speaker being in wireless communication with the smart phone through wireless communication; and a hook structure comprising a pivoting structure that articulates between a flat nested position within a rear surface of the housing and an extended upward position.

4. The waterproof portable entertainment system of claim 3, wherein said pivoting structure may further be articulated to a position angularly disposed to the rear surface of the housing and forming a surface stand for supporting the housing in a generally upright orientation while placed flat on a horizontal surface.

5. A shower entertainment system comprising:

a waterproof exo-housing forming a cavity for receiving a smart phone;

a waterproof speaker supported within said exo-housing and in operational interconnection with the smart phone when contained within the cavity;

an attachment system connected to and supporting the waterproof exo-housing, wherein the attachment system comprises a hook structure that extends from the protection housing to allow for retention from a shower head or connection plumbing to a shower head and wherein the hook structure is rigidly formed as an extension of or connection to the housing in a cantilevered fashion wherein said hook structure further comprises a pivoting structure that articulates between a flat nested position within a rear surface of the housing and an extended upward position; and a touchscreen access screen facilitating manual control of the speaker through the smart phone.

6. The shower entertainment system of claim 5, wherein said pivoting structure may further be articulated to a position angularly disposed to the rear surface of the housing and forming a surface stand for supporting the housing in a generally upright orientation while placed flat on a horizontal surface.

* * * * *